United States Patent [19]

Makihara et al.

[11] Patent Number: 4,638,851

[45] Date of Patent: Jan. 27, 1987

[54] COOLING APPARATUS FOR METAL STRIP

[75] Inventors: Katsumi Makihara; Kenichi Yanagi; Takeo Fukushima, all of Hiroshima; Namio Suganuma, Kurashiki; Ichiro Samejima, Kurashiki; Seiichi Takahashi, Kurashiki, all of Japan

[73] Assignees: Mitsubishi Jukogyo Kabushiki Kaisha; Kawasaki Steel Coporation, both of Tokyo, Japan

[21] Appl. No.: 722,213

[22] Filed: Apr. 11, 1985

[30] Foreign Application Priority Data

Apr. 17, 1984 [JP] Japan ..... 59-75809

[51] Int. Cl.[4] ..... B21B 13/02

[52] U.S. Cl. ..... 165/32; 165/39; 165/89

[58] Field of Search ..... 165/32, 39, 89

[56] References Cited

U.S. PATENT DOCUMENTS 2,971,460 2/1961 Shindle ..... 165/89 X 3,780,796 12/1973 Miram et al. ..... 165/39

4,459,726 7/1984 O'Brien ..... 165/89 X

*Primary Examiner*—Allen M. Ostrager

*Attorney, Agent, or Firm*—Wenderoth, Lind & Ponack

[57] ABSTRACT

An apparatus in which a metal strip is passed in contact partly around the outer circumferences of a number of spaced cooling rolls through which coolant passes. The apparatus includes temperature detectors for detecting the temperature of the strip before contact with each of the cooling rolls, and coolant temperature regulators controlled in accordance with the detected temperature of the strip to adjust the temperature of the coolant passing through each cooling roll to a range which limits the temperature drop of the strip such that unacceptable irregularities or distortions in the configuration of the strip cannot occur. The coolant used for each cooling roll is selected with a boiling point appropriate to the respective detected temperature for each roll. In the preferred arrangement, further temperature detectors are provided for each cooling roll to detect the temperature of the coolant, and output signals from both detectors are inputted to a control for regulating a flow rate valve.

7 Claims, 7 Drawing Figures

COOLING APPARATUS FOR METAL STRIP

BACKGROUND OF THE INVENTION

The present invention relates to apparatus for cooling strip metal, for example, during passage of the strip through a continuous annealing line, galvanizing line, or the like.

A typical known arrangement for the continuous cooling of strip metal processed in a continuous annealing furnace, or the like, is schematically shown in FIG. 1(*a*). Thus, strip metal 2 is fed around a plurality of spaced cooling rolls 1 so that the strip is cooled at the areas in contact with these cooling rolls, while passing therethrough. These cooling rolls 1 are, as typically shown in FIG. 1(*b*), of such a construction that they are rotatably supported on bearings 3, and have a helical or spiral passage 5 formed in the radially inner surface of a shell 4, around the outer surface of which the strip 2 passes in contact relationship. A pair of rotary coupling joints 6 are provided, adapted to inter-communicate with the mentioned spiral passage 5 via a rotating shaft 7, and through which cooling water is fed into the spiral passage 5 for cooling the shell 4. The number of cooling rolls 1 may vary depending upon the amount of cooling required of the strip.

With such conventional cooling arrangements, a drawback has been found due to occasional irregularities or distortions in the general configuration of the strip metal. More specifically, it is known that configurational distortions of the strip are attributable to certain irregular thermal stresses as a result of occassional deviations in temperature distribution widthwise of the strip. Such uneven temperature distribution can be caused by uneven contact of the strip with the surfaces of the cooling rolls, e.g. due to biased or uneven stretching existing in the strip. Also, the extent of such uneven widthwise temperature distribution could increase as the cooling rate of the strip per pass through a cooling roll increases. As a consequence, it is possible in practice to prevent such distortions of the strip from occurring, if the cooling rate of the strip metal per pass of a roll is limited to a range which ensures that no distortions of the strip can occur; however, this limitation causes a further problem, which is attributable to the conventional use of water as coolant for the cooling rolls, as follows:

It is normal practice for controlling the cooling effect rendered upon the strip metal, that the volume of water passing through the cooling rolls can be changed, and that the temperature of the cooling water be changed; this, however, causes the following problem, i.e., in the case that the volume of water is decreased at a time when the temperature of the strip is high, the cooling water could possibly be vaporized, which would then cause an occasional mismatching in the cooling effect widthwise of the strip. On the other hand, if the temperature of the cooling water is high, again there could be the possibility of the cooling water boiling or vaporising, thereby to cause uneven cooling widthwise of the strip. Worse still, it is to be noted that the range of control of the cooling rates attainable from such an arrangement would be substantially small, i.e. the volume of cooling water cannot be decreased significantly in view of the possibility that it will boil or vaporize, and with a change of water temperature say from 20° to 90° C., the control range attained at a strip temperature of around 800° C. could be as small as 10% or so; even with a strip temperature of 400° C., the control range would be merely 20% or so.

Therefore, the typical arrangement for cooling strip metal as discussed above, is such that the angle of contact, and hence the area of contact between the strip and the cooling roll shells must be adjusted; this is effected in practice mostly from a change in the cooling roll positions. However, if a change of cooling roll positions to achieve a required cooling capacity is effected on every occasion that the material and thickness of strip and the running velocity of the strip cooling line is changed, this could substantially affect the parallelism between adjacent pairs of cooling rolls. This would then be not only a cause of mistracking or zig-zag running of the running strip, but also a further cause for unbalanced contact between the strip and the cooling rolls.

OBJECT AND BRIEF SUMMARY OF THE INVENTION

In view of the drawbacks and problems discussed above with known arrangements, the object of the present invention is to provide cooling apparatus which is adapted to prevent the occurrence of the irregularities and distortions in the configuration of strip metal without the need to change the angle of contact between the strip and cooling rolls.

According to the invention, cooling apparatus for metal strip of the kind in which the strip is passed in contact partly around the outer circumferences of a number of spaced cooling rolls, through which coolant passes, is characterized in that temperature detection means are provided for detecting the temperature of the strip metal before contact with each said cooling roll, in that coolant temperature adjusting means are provided which, in dependence upon the detected temperature, are adapted to adjust the temperature of the coolant passing through each cooling roll to a range which limits the temperature drop such that unacceptable irregularities or distortions in the configuration of the strip cannot occur, and in that the coolant used for each cooling roll is selected with a boiling point appropriate to the respective detected temperature for each roll.

FIG. 2 is a graph showing the results of a series of experiments conducted by the inventors as to the influence of the average temperature T of strip metal and the differential temperature T observed widthwise of the strip upon the possibility of configurational distortions of the strip occurring. In FIG. 2, marks O, Δ and X are used, the mark O showing cases of good quality of configuration or shape of the strip, Δ showing cases of fair quality, and X showing the cases of poor quality. Cases of fair quality in configuration are considered here to mean strips having a degree of bowing or warping therein; cases of poor quality configuration are considered to mean strips having an appreciable waving or stretching, or even crumpling or wrinkling. The series of experiments were conducted on a plurality of steel strips having thicknesses ranging from 0.5 to 1.2 mm and a width ranging from 800 to 1,200 mm, stretched across a group of cooling rolls with tensions ranging from 0.5 through 3.0 kg/mm$^2$. These steel strips were measured for their average temperatures T and their widthwise differential temperature ΔT after having passed through the cooling procedure, and their configurations were tested visually for any irregularities.

From the results of the experiments discussed above, it was observed that there is no substantial influence from the thickness, width and tension of the strips for configurational distortions of the strips to occur and, as shown in FIG. 2, that such configurational distortions of the strips may be controlled in terms of the average strip temperature T and the widthwise differential temperature ΔT of the strip, accordingly. In addition to the cooling procedure noted above, a series of heat treatment experiments was conducted by using a group of rolls for strip temperature of up to 400° C. or so, and it was found that the occurrence of improper configurational distortions was generally similar to that found with said cooling procedure.

Referring further to FIG. 2, it will be noted that the higher the strip temperature T, the greater is the extent of configurational distortions with smaller differential temperature ΔT. This is because the cause for occurrence of such configurational distortions of the strip metal is attributable to the thermal stresses present, due to uneven distribution of temperatures widthwise of the strips, and because of plastic deformation of the strip metal when the thermal stresses increase beyond the stress yield point of the strip material; it is considered that as a result of decreasing thermal stresses as the temperature of the strip metal decreases, there would then occur improper configurational distortions, even with a small differential temperature.

Now, in view of the results of the experiments discussed above with reference to FIG. 2, the inventors have found that areas where such configurational distortions are likely to occur can be expressed by way of the following formula:

$$\Delta T > 90 - 1/10\ T$$

That is to say, with a smaller value of ΔT than this particular limit value, the less such configurational distortions may occur, and conversely, the more such configurational distortions may be observed, when ΔT is in excess of such limit value. As a consequence, the inventors propose that, for the due control of temperature widthwise of the strip metal, it is desirable to follow the range of adjustment as expressed by the following formula:

$$\Delta T \leqq 90 - 1/10\ T \tag{1}$$

Referring now to FIG. 3, this is a graph showing the relationship between maximum temperature drop TH and minimum temperature drop TL as observed widthwise of the strip metal in a further series of experiments conducted by the inventors. It can be seen from the graph that there exists a relationship between these two temperature drops as expressed by the following formula:

$$TH \geqq TL \geqq 1/5\ TH \tag{2}$$

More specifically, the graph confirms that there is the possibility of occurrence of a difference of 1:5 in the rate of heat transmission as observed widthwise of the strip metal, due to a possible unevenness in contact of the strip with the cooling rolls.

From the results obtained from these above experiments, the inventors have found that the allowable extent of temperature drop of the strip metal per pass through a cooling roll to ensure that no substantial configurational distortions of the strip occur is as shown in the graph referenced FIG. 4. In FIG. 4, there is plotted the temperature of strip metal Ts1 prior to the start of the cooling process on the abscissa axis, while the allowable extent of temperature drop of the strip Tsm is plotted on the ordinate axis. From FIG. 4, the allowable extent of the temperature drop Tsm where there is no improper configurational distortions of the strip may be expressed by the following equation:

$$Tsm = 115 - \tfrac{1}{8} Ts1 \tag{3}$$

On the other hand, with the differential temperature ΔTs between the strip temperature Ts1 prior to the start of the cooling process (temperature prior to contact with the cooling roll) and the strip temperature Ts2 after contact with the roll, this may generally be expressed in the following equation:

$$\Delta Ts = \frac{K \cdot A}{G \cdot C} (\overline{Ts} - \overline{Tw}) \tag{4}$$

where,

K designates the coefficient of overall heat transmission between the strip metal and the coolant inside the cooling roll (kcal/m$^2$h°C.);

A designates the area of contact between the strip of metal and the cooling roll (m$^2$);

G designates the throughput of the strip metal (kg/Hr);

C designates the specific heat of the strip metal (kcal/kg°C.);

$\overline{Ts}$ designates the average temperature of the strip metal at the area of contact with the cooling roll (°C.); and $\overline{Tw}$ designates the average temperature of the coolant (°C.).

As a consequence, in order to have the strip metal cooled off properly without any configurational distortions generated during the cooling process, the inventors propose to have the value ΔTs limited in accordance with the following calculation as obtained from equation (3), as follows:

$$\Delta Ts = \frac{K \cdot A}{G \cdot C} (\overline{Ts} - \overline{Tw}) \leqq Tsm = 115 - \tfrac{1}{8} Ts_1 \tag{5}$$

Now, it is the practice that the average temperature $\overline{Ts}$, as in equation (5), is generally taken by the logarithmic mean temperature, and the equation (5) may be expressed in the following formula in terms of the temperature of the strip metal prior to the start of the cooling process (prior to contact with the cooling roll) Ts1: i.e., $$\overline{Tw} \geqq Tsm \left\{ \frac{1}{\ln\left(\frac{Ts1}{Ts1 - Tsm}\right)} - \frac{G \cdot C}{K \cdot A} \right\} \tag{6}$$

where $Tsm = 115 - \frac{1}{8} \cdot Ts1$

Furthermore, it is essential that the coolant passing through the interior passage of the cooling roll is preferably held with an as small as possible temperature change observed widthwise of the strip metals, in order to attain the effect of even cooling widthwise of the strip. In this respect, it is the practice that the cooling process is designed with a relatively large coolant flow rate so that the temperature rise of the coolant in the interior of the cooling roll may be held to be as small as possible in practice. In this respect, it can then be allowed in practical design that the average temperature of the coolant $\overline{Tw}$ be taken to be equal to the coolant temperature at the entrance to the cooling roll Tw1. As a consequence, therefore, equation (6) may be practicably be converted to the following formula:

$$Tw1 \geqq Tsm\left\{\frac{1}{\ln\left(\frac{Ts1}{Ts1-Tsm}\right)}-\frac{G\cdot C}{K\cdot A}\right\} \quad (7)$$

where, $Tsm = 115 - \frac{1}{8}\cdot Ts1$.

Now take, for instance, the case of a typical annealing furnace for a strip of soft steel having a throughput G of the order of 5,500 kg/Hr, (which is the general size of such application) in which the soft steel strip, having a width of 1.5 m, is to be cooled by a cooling roll having a diameter of 1,500 mm at an entry angle of 120 degrees, and in which the value of the coefficient of overall heat transmission K is generally considered to be 700 kcal/m$^2$h°C. The allowable temperature drop preventing the occurrence of any configurational distortions of the strip steel Tsm for the strip temperature prior to the start of the cooling process Ts1 and the temperature of the coolant at the entrance to the cooling roll Tw1 is as shown in the Table 1 below.

TABLE 1

| Ts1 (°C.) | Tsm (°C.) | Tw1 (°C.) |
|---|---|---|
| 800 | 15.0 | 737 |
| 700 | 27.5 | 585 |
| 600 | 40.0 | 433 |
| 500 | 52.5 | 280 |
| 400 | 65.0 | 128 |

In this respect, in this particular example, it is practicably possible to have the strip metal cooled properly without the occurrence of any configurational distortions of the strip, by controlling the temperature of the cooling rolls at the entrance thereto Tw1 with respect to the strip temperature prior to the start of the cooling process Ts1. In this example, it is noted that when the temperature Tw1 is higher than 100° C. while using cold water as the coolant, it is impossible to take advantage of such proper control. However, it does become practicable for such control, if coolant of an appropriately higher boiling point is adapted in accordance with the actual temperature Tw1, as typically shown in Table 2 below.

TABLE 2

| Temperature Range | Type of Coolant |
|---|---|
| Tw1 < 100° C. | Water |
| 50° C. ≦ Tw1 ≦ 300° C. | Oil |
| 150° C. ≦ Tw1 ≦ 800° C. | Molten salt |

BRIEF DESCRIPTION OF THE DRAWINGS

The present invention is based on the knowledge obtained from the experiments as discussed hereinbefore and a preferred embodiment will now be described, with reference to the accompanying drawings in which:

FIG. 1(*b*) is a fragmentary longitudinal cross-sectional view of a known construction of cooling roll;

DETAILED DESCRIPTION OF THE PREFERRED EMBODIMENT

Figure 5:
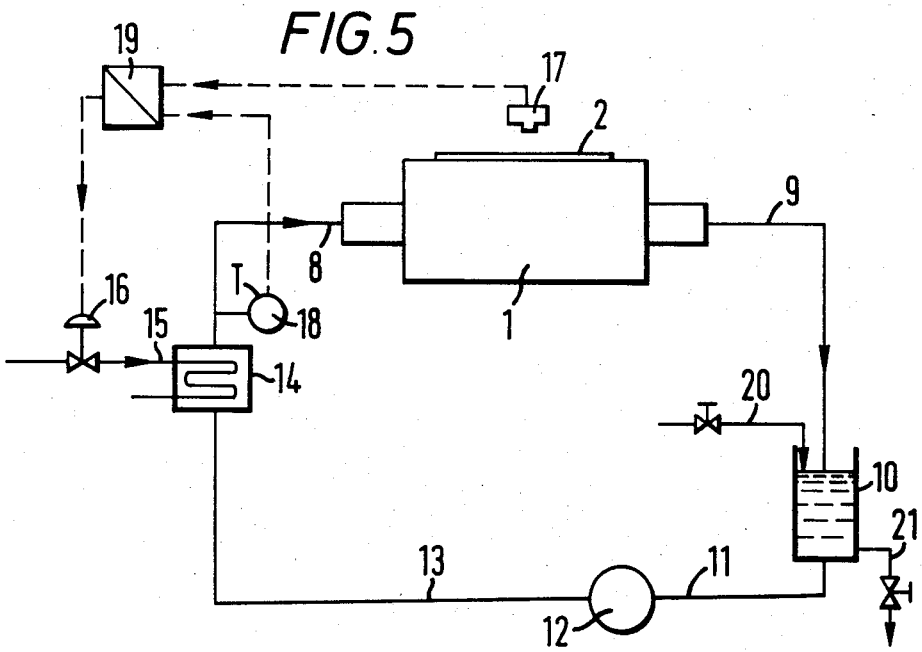
FIG. 5 is a schematic general diagram showing a preferred constructional embodiment of the invention.

Referring to FIG. 5 there is shown a strip of metal 2 wrapped around the shell of a cooling roll 1 which is rotatably supported. Over the area of engagement in contact with the peripheral outer surface of the roll, the strip 2 is cooled off. The cooling roll 1 is provided as described hereinbefore, with a spiral-shaped passage (not shown) around the inner surface of its shell, and coolant is introduced via a supply pipe 8 into the spiral passage. The coolant after abstracting heat from the strip 2 is discharged via a discharge pipe 9.

The discharge pipe 9 is connected in communication with a storage tank 10 which is in turn connected with the cooling roll 1 through a supply pipe 11, a pump 12, a supply pipe 13, a heat exchanger 14 and the above mentioned supply pipe 8, in that order. Thus, coolant stored in the storage tank 10 is circulated through the cooling roll 1 by operation of the pump 12. The heat exchanger 14 comprises tubing 15 designed to receive cooling or heating fluid as appropriate, which fluid is regulated to an appropriate flow rate by a flow rate regulating valve 16, whereby the temperature of the coolant can be properly adjusted.

A temperature detector 17 is positioned and adapted to detect the temperature of the strip 2 prior to its contact with the cooling roll 1, and a further temperature detector 18 is positioned and adapted to detect the coolant temperature to be fed into the cooling roll 1. The output signals from these detectors are inputted to a control 19, by which the flow rate regulating valve 16 is regulated in accordance with these signals so that the coolant temperature may be properly adjusted. More specifically, it is arranged that the coolant temperature is adjusted on the basis of the temperature of the strip 2 prior to the start of the cooling operation as detected by the temperature detector 17, so that the coolant may be held at a temperature Tw1, as obtained from formula (7) above, that gives an allowed temperature drop Tsm which ensures that configurational distortions of the strip do not occur.

Also, the storage tank 10 is provided with a coolant supply pipe 20 and a coolant discharge pipe 21 arranged in such a manner that the coolant passing through the cooling roll 1 may be exchanged with another appropriate coolant, in accordance with the temperature of the strip 2 fed therethrough. More specifically, the kind of coolant may be selected as shown typically in Table 2, in accordance with the coolant temperature Tw1 as specified from the temperature Ts1 of the strip 2.

Figure 1A:
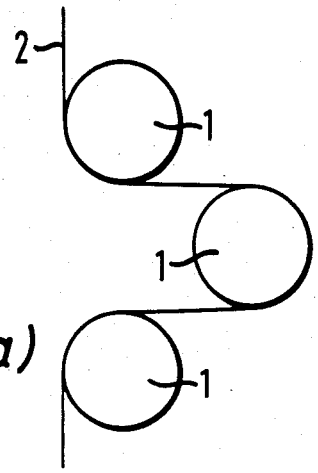
FIG. 1(*a*) is an explantory view showing a known arrangement by which strip metal is wound around a series of spaced cooling rolls.
Figure 1B:
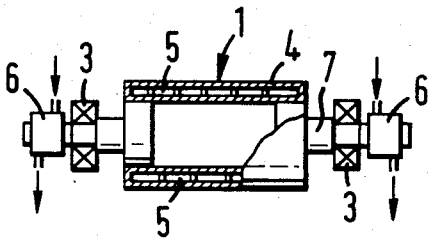
Figure 6:
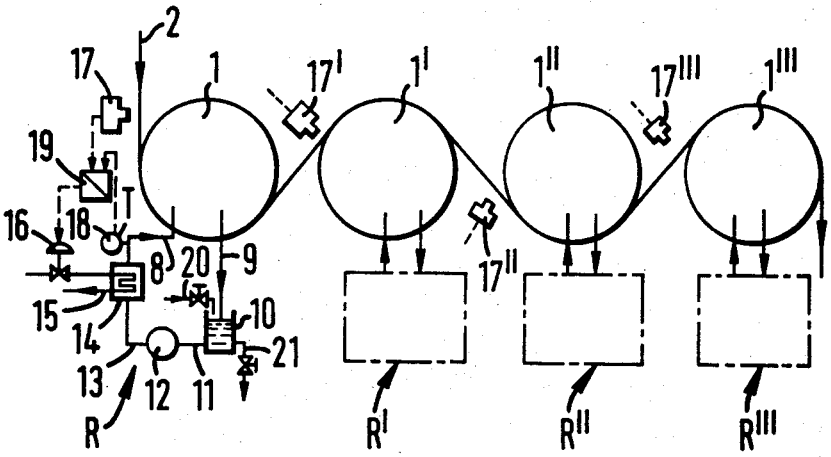
FIG. 6 is a schematic view showing the general arrangement of the cooling rolls of said preferred embodiment.
Figure 2:
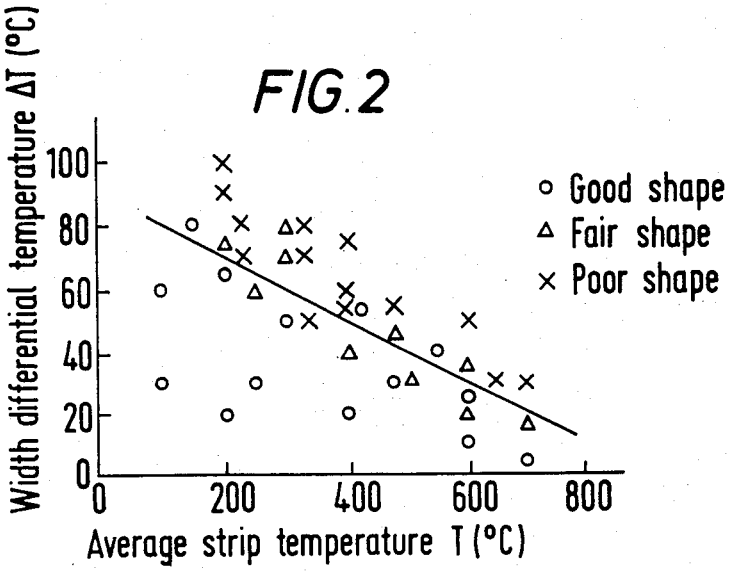
FIG. 2 is a graphic representation showing the influence of average temperature T and differential temperature T observed widthwise of a strip of metal upon the occurrence of possible configurational distortions of the strip.
Figure 3:
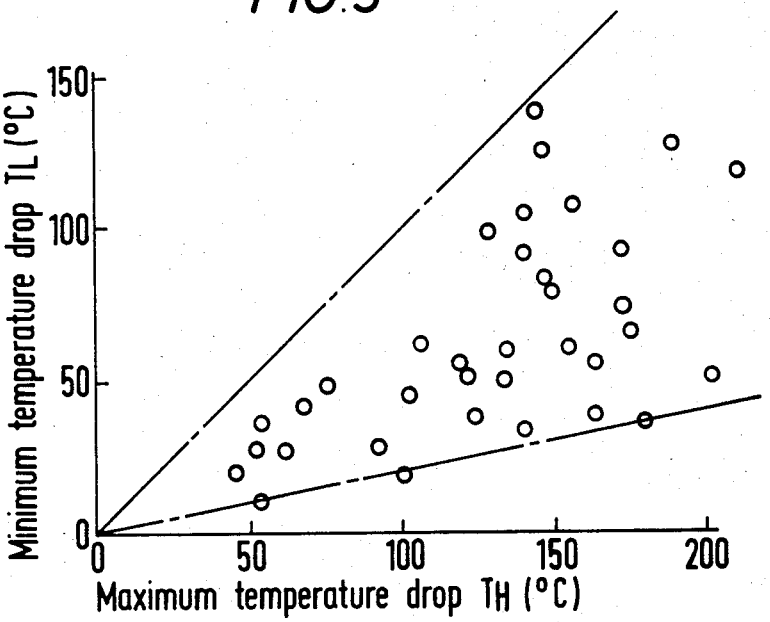
FIG. 3 is a similar graphic representation showing the relationship between the maximum and minimum temperature drops TH and TL observed withwise of a strip of metal.
Figure 4:
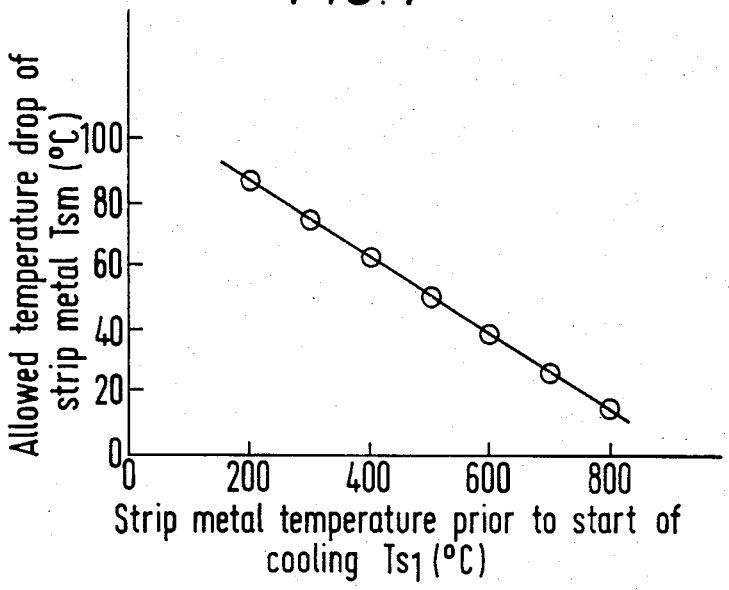
FIG. 4 is a graphic representation showing the relationship between strip metal temperature Ts1 prior to the start of a cooling operation and the allowed temperature drop Tsm to avoid the occurrence of configurational distortions of the strip.

Referring to FIG. 6 the general layout of the cooling line comprises a series of cooling rolls 1,1′,1″ and 1‴ for the sequential cooling operation of the strip metal, each having its own coolant circulating system R,R′,R″ and R‴ respectively. In this cooling system, it is arranged that the strip of metal 2 is cooled-off in sequence as it passes in contact with each of the cooling rolls. The coolant fed into each of these cooling rolls is controlled at respective temperatures Tw1 in terms of a limit value (as obtained from formula (7) above) on the basis of the temperature Ts1 of the strip metal 2, as detected by respective temperature detectors 17,17′,17″ and 17‴ upstream of each of the cooling rolls. Also, the type of coolant is selected appropriately, in accordance with the specification shown in the Table 2, where the different types are defined in terms of the range of coolant temperature Tw1 required. More specifically, it can be seen that the appropriate coolant is selected to be molten salt, oil and water in the order of cooling steps from the upstream end of the strip metal 2, in terms of the required strip temperature, at each of the cooling steps. For example, it may be that molten salt is selected for the first cooling step provided by cooling roll 1, oil for the next step (cooling roll 1′) and water for the further steps (cooling roll 1″, 1‴, respectively). Of course, it could happen that the same coolant may be used for two or more cooling steps, in which case the circulating system for the coolant may well be designed to be common for the corresponding cooling rolls, yet providing for independent temperature adjustment at the entrance to each such cooling roll.

While coolants such as molten salt, oil and water as typical examples are proposed above in respect of the preferred embodiment, it is to be understood that the present invention is not restricted to such coolants. In addition, the formulae adapted as discussed above to obtain the required coolant temperatures may likewise be changed in accordance with the changes in conditions such as the kind of strip material, or the like, as desire.

As explained fully in the foregoing, in accordance with the present invention, it is made possible to present an advantageous cooling process for strip metal in which configurational distortions of the strip are avoided, or at least substantially reduced, without the necessity to change the angle of contact between the strip and the cooling rolls in the system.

What is claimed is:

1. An apparatus for cooling metal strip, comprising:

a plurality of cooling rolls disposed for having the strip pass successively thereacross in contact with a segment of the outer circumferential surfaces thereof;

means for passing a respective flow of coolant through each of said cooling rolls so as to cool the strip as the strip passes across said cooling rolls; and a plurality of temperature detectors and a plurality of coolant temperature adjusters, one each of said detectors and said adjusters being associated with a respective one of said cooling rolls, each of said detectors comprising a means for detecting the temperature of the strip prior to contact of the strip with the associated cooling roll and a means for providing a strip temperature signal indicative of said temperature, each of said adjusters comprising a means for adjusting the temperature of the coolant passing through the associated cooling roll to a corresponding predetermined temperature range in response to the strip temperature from said strip temperature signal providing means of the temperature detector associated with said associated cooling roll, so as to limit the temperature drop of the strip as it passes across the associated cooling roll, to thereby limit temperature related irregularities and distortion in the configuration of the strip;

said means for passing a respective flow of coolant comprising means for passing through each cooling roll a respective flow of liquid coolant having a liquid state in the predetermined temperature range corresponding to the adjuster associated with said each cooling roll.

2. An apparatus as in claim 1, wherein said temperature adjusting means comprises a flow rate regulating valve for adjusting the rate of flow of coolant through the associated cooling roll and means, responsive to said strip temperature signal, for controlling said valve.

3. An apparatus as in claim 2, wherein said temperature adjusting means further comprises means for detecting the temperature of the coolant in the associated roll and means for providing and inputting to said means for controlling said valve a coolant temperature signal indicative of the temperature of the coolant in the associated cooling roll detected by said coolant temperature detecting means, said controlling means being responsive to said coolant temperature signal and said strip temperature signal for controlling said valve.

4. An apparatus as in claim 3, wherein if the coolant temperature at an entrance of a cooling roll is represented by the symbol Tw1, then the controlling means controls the coolant temperature at the entrance of each cooling roll in accordance with the following formula:

$$Tw1 \geqq Tsm\{1/1n(\mathrm{Ts1}/(Ts1-Tsm))-GC/KA\},$$

wherein $Tsm = 115°\ \mathrm{C.} - \frac{1}{8}Ts1$,

Ts1 designates the temperature of the strip detected by said strip temperature detecting means, G designates the throughput of the strip metal in kg/hr, C designates the specific heat of the strip metal in kcal/kg°C., K designates the coefficient of overall heat transmission between the strip metal and the coolant inside the coolant roll in kcal/m$^2$hr°C., and A designates the area of contact between the strip of metal and the cooling roll in m$^2$.

5. An apparatus as in claim 1, wherein if the coolant temperature at an entrance of a cooling roll is represented by the symbol Tw1, then the controlling means controls the coolant temperature at the entrance of each cooling roll in accordance with the following formula:

$$Tw1 \geqq Tsm(1/1n(Ts1/(Ts1-Tsm))-GC/KA),$$

wherein $Tsm = 115°\ \mathrm{C.} - Ts1$,

Ts1 designates the temperature of the strip detected by said strip temperature detecting means, G designates the throughput of the strip metal in kg/hr, C designates the specific heat of the strip metal in kcal/kg°C., K designates the coefficient of overall heat transmission between the strip metal and the coolant inside the coolant roll in kcal/m$^2$hr°C., and A designates the area of contact between the strip of metal and the cooling roll in m$^2$.

6. An apparatus as in claim 1, wherein the temperature of the coolant Tw1 just before entering each cooling roll is in one or more of the following ranges: less than 100° C., between 50° C. and 300° C., and between 150° C. and 800° C.; and wherein the coolant is selected from one of the following coolants as follows: water for Tw1 less than 100° C., oil for Tw1 between 50° C. and 100° C., and molten salt for Tw1 between 150° C. and 800° C.

7. Cooling apparatus according to claim 1, wherein said passing means comprises a coolant circulation system for each cooling roll, each system comprising a storage tank, a discharge pipe from the respective cooling roll in communication with said storage tank, said storage tank being connected to the cooling roll via supply pipes having therein a pump and a heat exchanger, the heating exchanger having tubing for one of cooling and heating fluid for adjusting the coolant to the required temperature.

* * * * *